United States Patent [19]

Higgins et al.

[11] Patent Number: 4,907,791

[45] Date of Patent: Mar. 13, 1990

[54] SIGNATURE FEEDER HAVING IMPROVED SIGNATURE EXTRACTION

[75] Inventors: George Higgins, Orland Park; James Wrona, Burbank, both of Ill.

[73] Assignee: McCain Manufacturing Corporation, Chicago, Ill.

[21] Appl. No.: 226,221

[22] Filed: Jul. 29, 1988

[51] Int. Cl.[4] ..... B65H 5/02

[52] U.S. Cl. ..... 271/5; 271/6; 271/94; 271/161; 271/188; 271/209

[58] Field of Search ..... 271/161, 166, 35, 177, 271/188, 209, 94–96, 99, 5, 6

[56] References Cited

U.S. PATENT DOCUMENTS

| | | | |
|---|---|---|---|
| 1,147,482 | 7/1915 | Cheshire | 271/161 |
| 3,101,942 | 8/1963 | Zyber | 271/177 |
| 3,522,943 | 8/1970 | Swanson | 271/35 X |
| 3,591,171 | 7/1971 | Schmidt | 271/188 X |
| 3,692,304 | 9/1972 | de Ridder | 271/188 |
| 4,177,982 | 12/1979 | Bewersdorf et al. . | |
| 4,204,672 | 5/1980 | Grivet | 271/188 |
| 4,336,929 | 6/1982 | Hanzlik | 271/35 X |
| 4,436,297 | 3/1984 | Chandhoke | 271/94 X |
| 4,618,136 | 10/1986 | Pessina et al. . | |
| 4,619,450 | 10/1986 | Anderson | 271/166 X |
| 4,660,819 | 4/1987 | Allocco | 271/161 X |
| 4,674,733 | 6/1987 | Pessina et al. . | |

FOREIGN PATENT DOCUMENTS

| | | | |
|---|---|---|---|
| 19630 | 1/1985 | Japan | 271/99 |

*Primary Examiner*—Richard A. Schacher

*Attorney, Agent, or Firm*—Kinzer, Plyer, Dorn, McEachran & Jambor

[57] ABSTRACT

A sheet feeder has a supply station wherein signatures fresh from the printing press are stacked. The stack is supported such that the signatures are in an arched, non-planar configuration. A sheet stripper extracts signatures successively from the stack and feeds them in a constant stream to a transfer conveyor. The stripper grips the sheets with a suction device which applies a constant but locally intermittent vacuum. The transfer conveyor carries the signatures to a delivery station. The delivery station includes fingers which arch the signatures. Arching the signatures in the supply and delivery stations prevents rolling of the signatures.

22 Claims, 4 Drawing Sheets

Fig. 3.
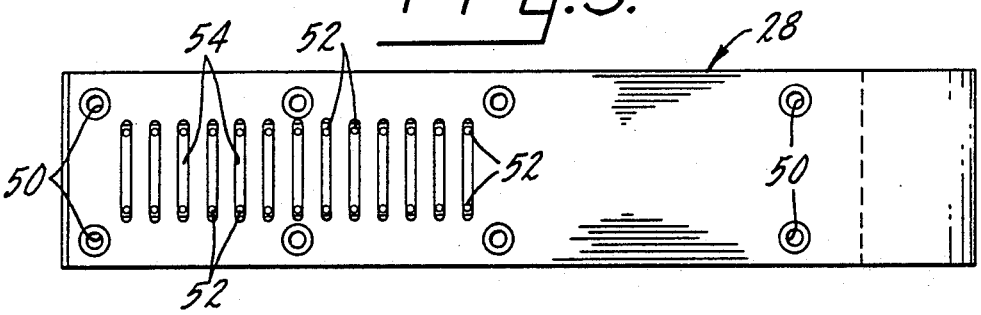
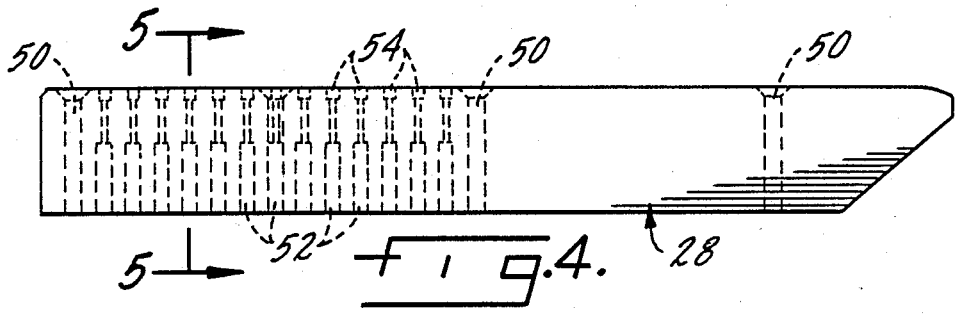
Fig. 4.
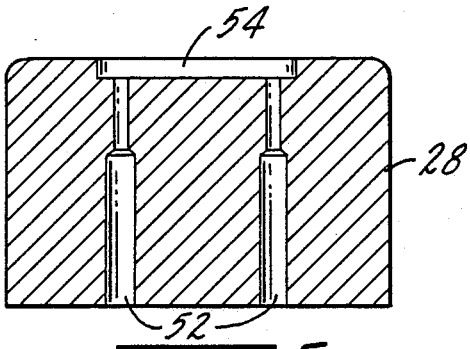
Fig. 5.
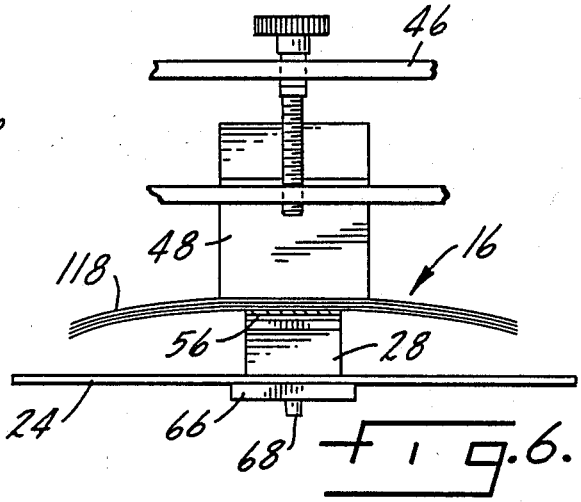
Fig. 6.
Fig. 7.
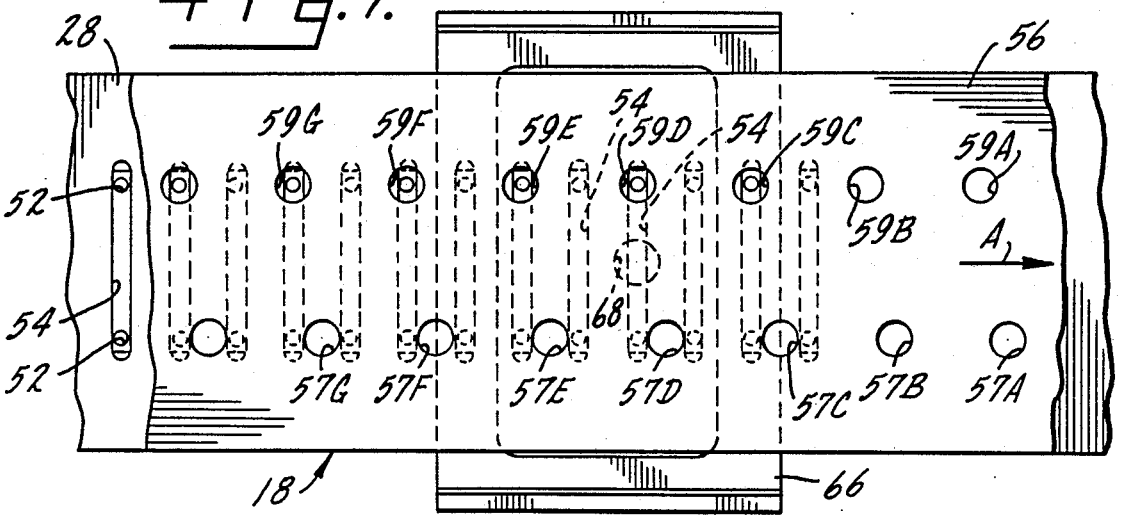

SIGNATURE FEEDER HAVING IMPROVED SIGNATURE EXTRACTION

BACKGROUND OF THE INVENTION

Saddle binding equipment for gathering signatures and binding them in book form is well known. See McCain U.S. Pat. No. 3,087,721. In these machines, signatures (which are folded sheets to be assembled in a book) are stacked in respective supply hoppers and are fed to a gathering chain moving past the hoppers, with one signature being dropped atop another. There may be as few as two active hoppers or as many as fifty or more hoppers, depending on the particular book being assembled.

As mentioned in McCain U.S. Pat. No. 3,589,712, it is necessary to keep the supply hoppers full with signatures. Further, it is necessary that the signatures be joggled or fanned or riffled prior to placing them in the supply hopper so they will not stick together as the result of friction, static electricity or fresh ink. This procedure is known as "breaking" the signatures. A sheet feeder for receiving freshly printed signatures, breaking them and transferring them to a supply hopper is shown in Bewersdorf U.S. Pat. No. 4,177,982. The disclosure of that patent is incorporated herein.

The supply station of the sheet feeder in the Bewersdorf patent is arranged to hold signatures in what is called a standing stack. The signatures in a standing stack lie in a generally vertical plane. That is, the signatures are placed edgewise on a generally horizontal support. It is desirable to load as many signatures as practical in the supply station of the sheet feeder so that the frequency of the loading operation may be minimized. Consequently, the supply station is made to be relatively large. Due to the essentially horizontal nature of the supply station, a relatively large amount of floor space is required to accommodate it.

In bindery shops where floor space is at a premium, it would be desirable to minimize the floor space required by the supply station by arranging it vertically as opposed to horizontally. In a vertical supply station the signatures would be arranged in a so-called flat stack, with one atop another. In other words, the signatures in a flat stack lie in a generally horizontal plane as opposed to the vertical plane of a standing stack.

A vertical supply station for a sheet feeder which breaks the signatures solves the floor space problem but leads to a different problem. In a flat stack or pile, most of the weight of signatures toward the top of the pile will bear on those near the bottom of the stack. Thus, a stripping mechanism for extracting signatures from the bottom of the pile will have to overcome not only friction, static electricity and sticking due to fresh ink, but also the weight of the upper signatures bearing down on the bottom one. These elements can combine to cause a condition known as "rolling."

As explained above, a signature is a folded sheet which has two portions called legs joined at a backbone. In a flat stack, the legs will be arranged one atop the other. The backbone will typically be leading. Rolling is defined as the condition resulting when the lowermost leg advances out of the pile under the influence of the stripper mechanism while the upper leg remains stuck to the adjacent signature in the pile. That is, the stripper mechanism will grab the lower leg and start moving it out of the stack. But the upper leg, instead of moving with the lower leg, remains stuck to the signature which is second from the bottom of the pile. Thus, when rolling occurs, the effect is an undesired unfolding of the signature. The signature legs tend to unfold or open up instead of moving out of the pile as a single folded unit.

Rolling is clearly an unacceptable condition for a sheet feeder. Although a flat stack is most prone to producing the rolling problem, it can also occur in a standing stack.

SUMMARY OF THE INVENTION

This invention relates to a sheet feeder which is adapted in particular to transfer freshly printed signatures to a supply hopper associated with bindery equipment. While the feeder may be used in the foregoing relation, it is not necessarily restricted to that particular use. It may also be used to feed signatures, or other sheet material, under any circumstance where it is necessary to successively feed single sheets in a stream to a delivery station.

One of the objects of the present invention is to eliminate rolling in a sheet feeder. It has been found that rolling can be eliminated by supporting the stack or pile in the supply station in an arched or non-planar condition. Arching the signatures imparts to them increased rigidity such that when a stripping mechanism engages a signature, it will be able to extract both legs of the signature simultaneously from the pile.

It has also been found to be beneficial to arch the signatures as they enter the delivery station. This is accomplished in the present invention by means of a pair of fingers which engage the edges of the signatures and gradually force them out of the plane of the center portion of the signature.

The present invention is also directed to an improved stripper mechanism for extracting sheets from the stack or pile. It is known to extract sheets using a traveling belt which grips sheets by transmitting a vacuum to the sheets through holes in the belt. However, it has been found that applying and maintaining a vacuum to a particular location on a sheet for too long a time period will damage the sheet. Apparently the sheet tends to get sucked down into the hole, thereby dimpling it at that particular spot. The present invention avoids this problem by providing stripper mechanism having a plurality of vacuum holes for gripping a sheet. The vacuum is applied intermittently at each hole. The timing of the vacuum application is such that at least one hole is operative to grip the sheet throughout the course of the extraction. Looking at the sheet as a whole, it will always be under the influence of the vacuum at some location. Thus, slipping of the sheet relative to the stripper belt is eliminated. But no particular hole will be activated for a time period long enough to damage the sheet. In other words, the vacuum application is globally constant (to prevent slippage) but locally intermittent (to prevent dimpling).

BRIEF DESCRIPTION OF THE DRAWINGS

FIG. 3 is a plan view of the riser block.

FIG. 4 is a side elevation view of the riser block.

FIG. 5 is a section taken along line 5—5 of FIG. 4, on an enlarged scale.

FIG. 6 is a section taken along line 6—6 of FIG. 2.

FIG. 7 is a plan view of a portion of the riser block, traveling belt and vacuum manifold.

DETAILED DESCRIPTION OF THE INVENTION

Figure 1A:
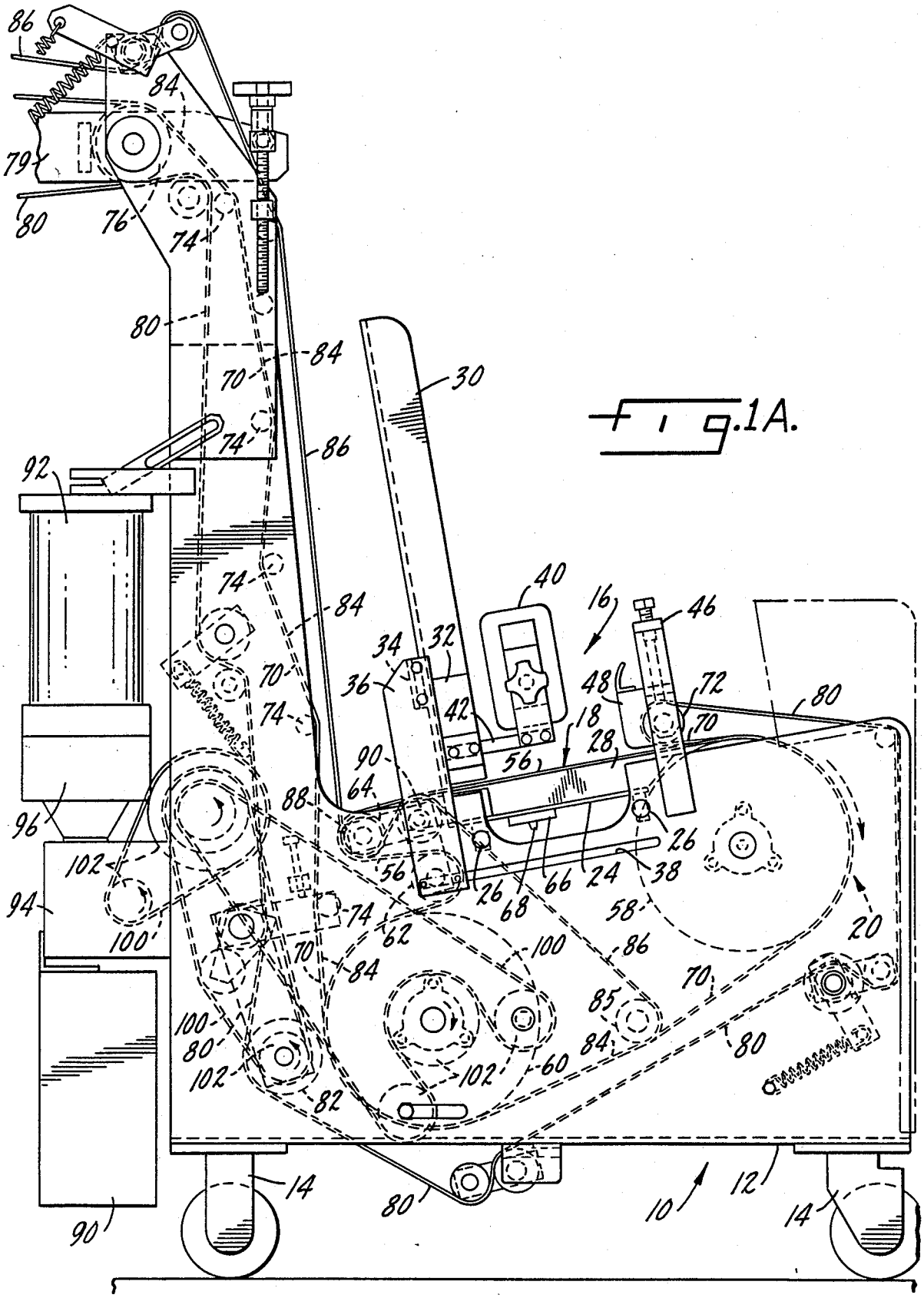
FIGS. 1A and 1B together form a side elevation view of a sheet feeder according to the present invention.
Figure 1B:
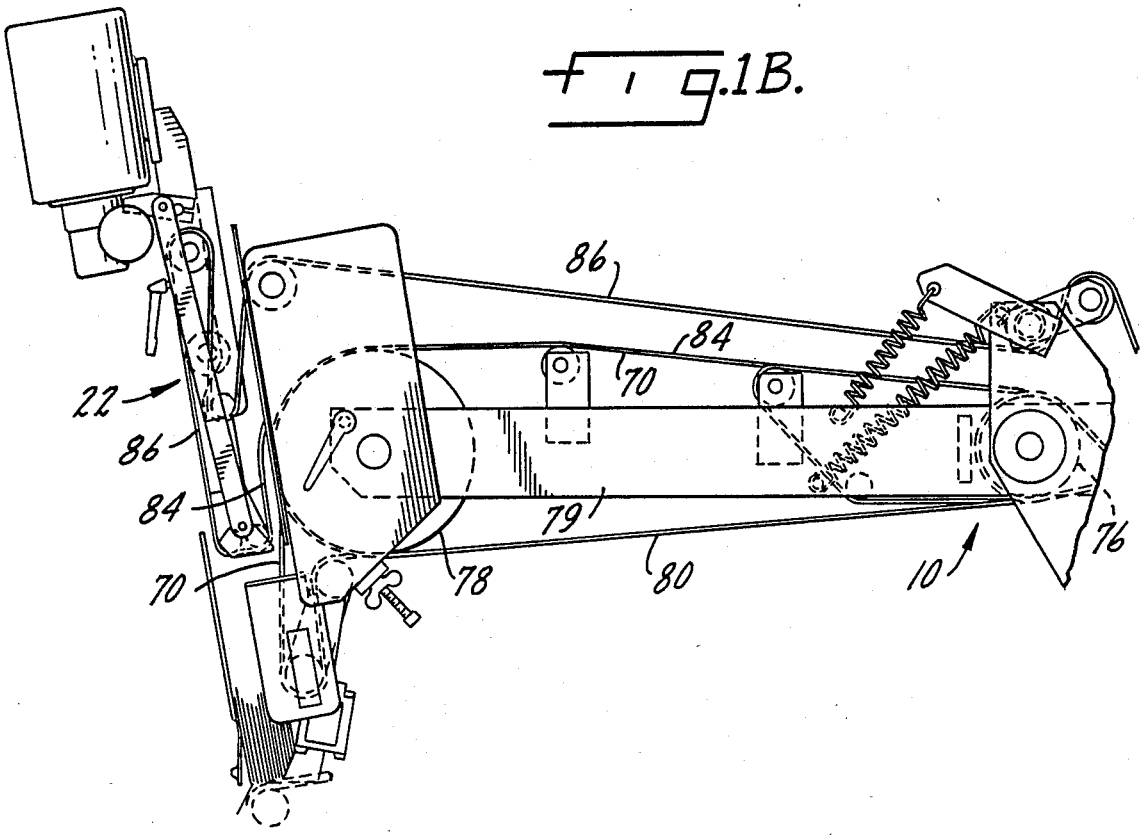

A sheet feeder suitable for loading signature feeders of the type described above is shown generally at 10 in FIGS. 1A, 1B and 2. The sheet feeder has a pair of side frames 12 which rest on casters 14 and provide support for the various feeder components. The feeder comprises a supply station shown generally at 16. A sheet stripper mechanism, shown generally at 18, extracts signatures from the supply station and advances them to a transfer means, indicated generally at 20. The transfer means carries signatures to a delivery station, shown at 22 (FIG. 1B).

The supply station 16 is defined by a plurality of elements, including a pile plate 24 connected to the side frames 12 by supports 26. A riser block 28 is mounted on top of the pile plate 24. The riser block is located approximately in the center of the pile plate. Details of the riser block will be described below. Generally speaking, the pile plate 24 and riser block 28 define the bottom of the supply station.

The rear corners of the supply station are defined by two sets of pile angles. Each set has upper and lower angle members 30 and 32. The upper and lower pile angles are adjustably fixed in slots in a pile angle bar 34. The pile angle bar in turn is mounted on pile angle brackets 36. The brackets 36 are clamped in slots 38 formed in the side frames 12.

The supply station further includes a pair of deflector assemblies 40 which are attached to the lower pile angles 32 by brackets 42. The remaining elements of the supply station include a center pile support 44 (FIG. 2) connected to the bar 34 in alignment with the riser block 28. A signature gate assembly 46 has a pair of upstanding arms attached to the side frames and connected by cross pieces. A signature guide 48 is adjustably connected to the gate assembly. The guide is aligned with the riser block 28.

Turning now to FIGS. 3–5, details of the riser block 28 are shown. The block includes eight holes 50 for receiving screws which attach the block to the pile plate 24. The block also has a plurality of ports 52 aligned in two longitudinal rows. Laterally aligned pairs of ports 52 are connected by grooves 54 in the upper surface of the block. The ports and grooves provide fluid communication from the bottom to the top surface of the block 28. For reference purposes only, the grooves may be one-eighth of an inch wide and spaced on three-eighth inch centers. The block itself may be about two and one-half inches wide, twelve inches long and one and five-eighths inches high.

Figure 2:
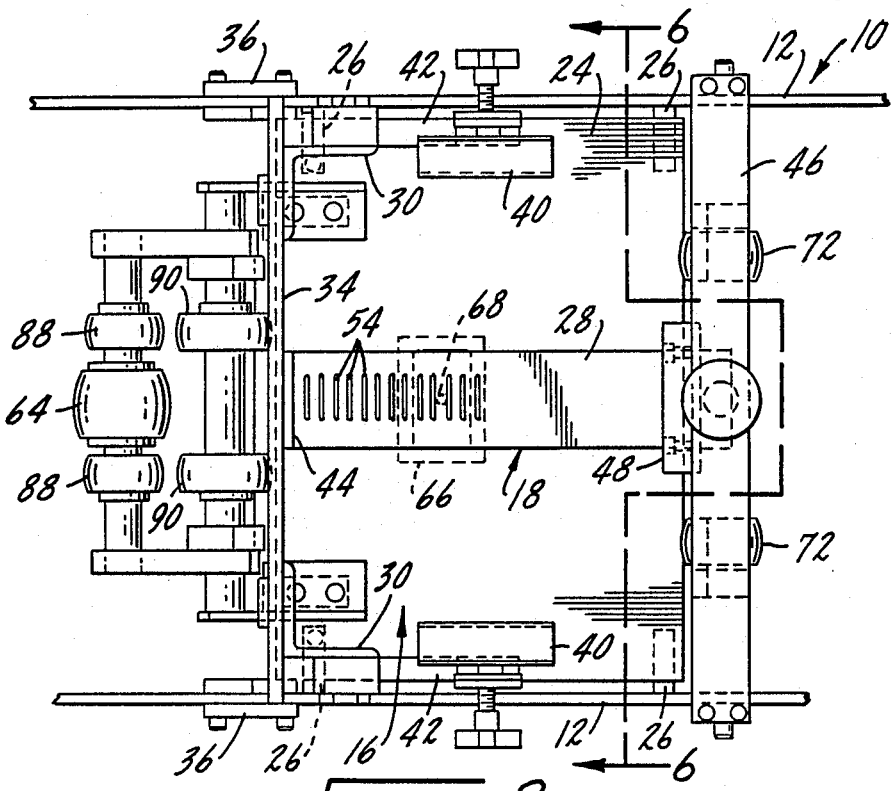
FIG. 2 is a plan view of the supply station.

Looking now at FIGS. 1A, 2 and 7, details of the sheet stripper means 18 will be described. The sheet stripper includes a vacuum belt 56 of a width approximately equal that of the riser block 28. The vacuum belt 56 revolves in an endless fashion about upper and lower drums 58 and 60. The drums rotate n a clockwise direction as seen in FIG. 1. The vacuum belt also revolves around idlers 62 and 64.

A vacuum manifold 66 is magnetically applied to the underside of the pile plate 24. The manifold has a nipple 68 for connection to a vacuum source (not shown). The manifold 66 communicates with a selected group of the ports 52 in the riser block 28 through openings (not shown) in the pile plate. Thus, a vacuum source is available at some of the grooves 54 on the upper surface of the riser block.

The vacuum belt 56 has a plurality of spaced holes or openings 57, 59 arranged in laterally spaced rows, as seen in FIG. 7. Holes in the two rows can be related to one another in pairs. The holes of a pair are designated in FIG. 7 with a common reference letter. The paired holes are staggered but overlapping in a longitudinal direction. That is, the centers of a pair are longitudinally spaced but by less than the diameter of the holes.

The belt 56 moves in the direction of the arrow A (FIG. 7). Thus, holes 57 lead the holes 59 in each pair. The pairs are spaced apart longitudinally. In other words, the centers of adjacent, non-paired holes are longitudinally spaced by greater than the diameter of the holes. So the trailing edge of a hole 59 is spaced from the leading edge of the next hole 57. For reference purposes only, the holes may be one-quarter inch in diameter, on three-quarter inch longitudinal centers, with one inch lateral separation between the centers of the hole rows. Longitudinal separation between centers of paired holes may be three-sixteenths of an inch.

Details of the transfer means 20 will now be described, using FIGS. 1A and 1B. The transfer means 20 comprises first and second sets of tapes which respectively engage the upper and lower surfaces of a signature to advance it from the stripper means 18 to the delivery station 22. The tapes revolve around a series of drums, rollers and idlers in an endless fashion. This action breaks the signatures. The forward run of the first set tapes is indicated at 70. The forward run is that portion of the tape travel wherein signatures are engaged. The forward run of the first tape set begins at idlers 72, continues past drums 58 and 60, and proceeds through a series of rollers 74, around a pulley 76 to delivery pulleys 78. The pulleys 76 and 78 are mounted on an upper frame member 79.

The return side of the first set of tape is illustrated at 80. The return run passes through several sets of idlers which are used to adjust the tension on the tapes. Return run 80 also passes a drive roller 82.

The second set of tapes begins a forward run 84 at roller 85. At this point, the forward run 84 of the second set of tapes joins the forward run 70 of the first tape set to engage both sides of the signatures. Forward run 84 moves past the lower drum 60 and then through the series of rollers 74 and past the pulley 76. The second tape set continues to the delivery pulleys 78. The return run of the second set of tapes is shown at 86. As in the case of the return run 80, run 86 passes through a set of idlers including those shown at 88 and 90 adjacent the supply station 16.

Power for driving the vacuum belt and transfer tapes is supplied by a motor 92 driving a gear box 94 through a clutch 96. These items are hung on the back of the frame as is an enclosure box 98 for electrical controls and the like. The gear box 94 is drivingly engaged with the lower drum 60 and drive roller 82 by means of chains 100 and sprockets 102.

Figure 9:
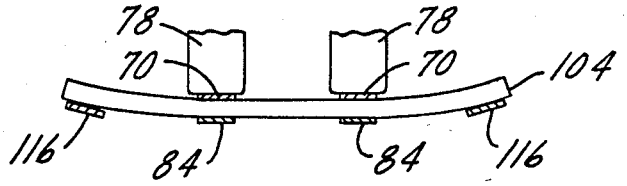
FIG. 9 is a section taken along line 9—9 of FIG. 8.
Figure 8:
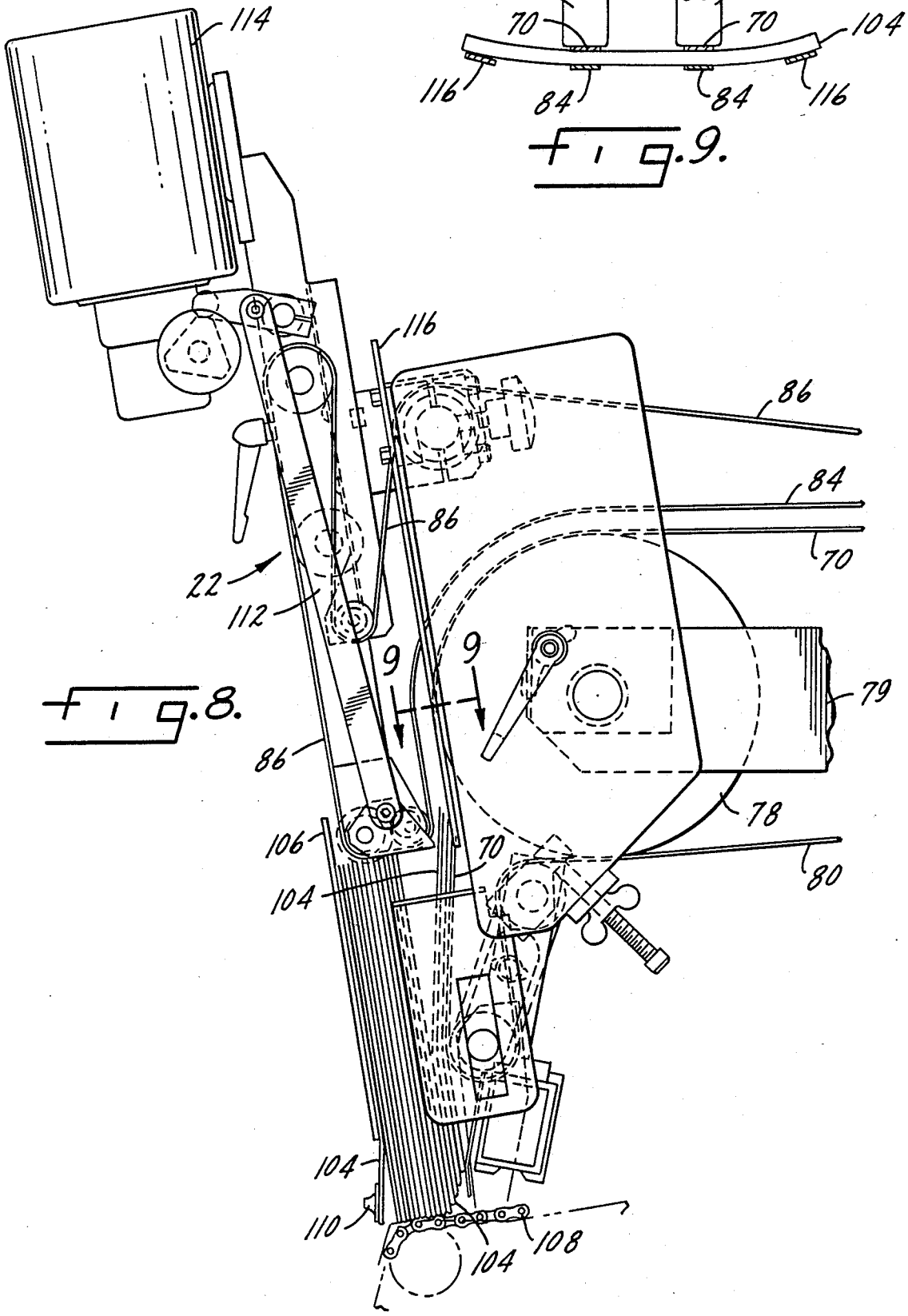
FIG. 8 is a side elevation view, on an enlarged scale, of the delivery station.

Turning now to FIGS. 8 and 9, details of the delivery station will be described. The forward runs 84 and 70 of the transfer tapes drive the signatures down into the hopper of a signature feeder. A plurality of signatures is indicated at 104. The stock plate 106, pile conveyor 108 and sucker 110 of the signature feeder are shown schematically. A conventional patter mechanism 112 is driven by a small motor 114. The patter assures an even stack in the hopper.

As the signatures are being carried around the delivery pulleys 78, they are contacted at or near their outer edges by fingers 116. The fingers 116 are rectangular bars which are mounted so that the full width or face of the bar engages the edges of the signature stream. This arrangement minimizes the chances of damaging the signatures. The purpose of the fingers is to once again arch the signatures as they enter the hopper of the signature feeder. FIG. 9 illustrates the arched configuration imparted to the sheets by the fingers. This has been found beneficial in that it prevents rolling which might otherwise tend to occur as the sheets enter the hopper.

The operation of the invention is as follows. Signatures fresh from the printing press are placed in the supply station in a flat pile or stack, the bottom portion of which is shown at 118 in FIG. 6. As can be seen in FIG. 6, the signatures are supported at their centers by the vacuum belt 56 and the riser block 28. The edges of the signatures are permitted to hang downwardly over the edges of the riser block toward the pile plate 24. Thus, the signatures have an arched, non-planar configuration in the supply station stack.

As the vacuum belt 56 moves past the pile, the vacuum is applied to the bottom signature, in a manner to be described below. The vacuum belt grabs the foremost or bottom signature in a suction grip, causing it to move forwardly with the belt. It has been found that by arching the signatures in the supply station, rolling can be prevented. With the signatures in a non-planar condition, there is no linear axis about which rolling can develop.

The signatures are successively moved out of the stack in a shingled stream, toward the bight of the transfer tapes 70. As the signatures are advanced toward the drum 58 by the vacuum belt, the edges of the signatures gradually engage the drum and shift from an arched configuration to a flat configuration. The stream of signatures proceeds around the drum 58, toward the roller 85. There, the second set of tapes 84 becomes operative on the signatures. The first set of tapes 70 and the vacuum belt 56 continue to be in contact with the signatures as they move around the lower drum 60. As the stream moves around drum 60, the vacuum belt 56 departs toward idler 62. The tapes 70 and 84 continue moving the stream toward the delivery station 22. Throughout this passage the signatures are being broken for easy, sure handling in the signature feeder.

Looking now at FIG. 7, operation of the sheet stripper will now be described. The manifold 66 is positioned as desired to activate (i.e., supply a vacuum to) a selected group of grooves 54. This controls the spacing between the sheets in the stream. In the position shown, it can be seen that hole pairs designated D and E are presently located in the active zone of the vacuum. But leading holes 57D, 57E are disposed precisely between grooves 54 so those holes are momentarily shut off from the vacuum supply. However, trailing holes 59D, 59E are squarely centered over the grooves 54 and are communicating the vacuum from the groove to the foremost signature. Obviously, as the belt 56 continues to move to the right in FIG. 7, holes 59D,E will move between grooves and release their vacuum grip on the signature. By time that happens, though, holes 57D,E will encounter succeeding grooves and will be active to grip the signature.

It can be seen that the size and spacing of the grooves and holes is such that, on an overall basis, the signature is always being gripped somewhere. But at a specific local site, the grip on the signature is intermittent. Thus, the gripping or suction location rotates among several different locations on the signature. This eliminates the possibility of damaging the signature by drawing it too deeply into the hole in the belt. At the same time, it assures accurate, consistent stripping and formation of the stream.

Whereas a preferred form of the invention has been shown and described, it will be realized that modifications could be made thereto without departing from the scope of the following claims.

We claim:

1. A machine for feeding signatures, having a first lap and a second lap joined at a backbone, to a delivery station, comprising:

a supply station in which the signatures are to be first loaded in a flat stack with the backbones perpendicular to the direction the signatures will be withdrawn, the supply station including support means for eliminating rolling of the signatures as they depart the supply station, the support means including a pile plate and a riser block mounted on the pile plate, the riser block having a width sufficiently less than the width of the signatures such that the edges of the signatures hang down over the sides of the riser block toward the pile plate, imparting a curvature to the signatures in the stack, the curvature being perpendicular to the direction the signatures will be withdrawn;

a signature stripper means engageable with the foremost signature of the stack for extracting signatures successively from the stack in the supply station; and transfer means for receiving signatures from the stripper means and advancing them in a stream to the delivery station.

2. The machine of claim 1 wherein the transfer means includes means for turning the signatures on edge at the delivery station to form a standing stack.

3. The machine of claim 1 wherein the transfer means includes conveyor tapes engageable with the signatures intermediate the edges of the signatures, and means for arching the sheets as they enter the delivery station.

4. The machine of claim 3 wherein the means for arching comprises a pair of fingers engaging the edges of the signature so as to deflect the edges of the signature out of the plane of the portion of the sheet engaged by the conveyor tapes.

5. The machine of claim 4 wherein the fingers are generally rectangular and are mounted so as to present the full width of the finger to the edges of the signatures.

6. The machine of claim 1 further comprising a manifold attached to the pile plate, the manifold adapted to be connected to a source of vacuum, and further wherein the riser block has a plurality of passages therethrough which are aligned with the manifold so as to communicate the vacuum source to the top surface of the riser block.

7. The machine of claim 6 wherein the signature stripper means comprises an endless belt positioned to traverse the top surface of the riser block while engaging the foremost signature of the stack, the belt having a plurality of openings therein which, by the motion of the belt, are successively connected and disconnected to the source of vacuum as they traverse the passages of the riser block, whereby the signature stripper means is effective to extract the foremost signature of the stack successively by a suction grip and advance them one by one into the transfer means.

8. The machine of claim 7 wherein the openings are arranged in the belt such that the timing of the connecting and disconnecting of openings to the vacuum source is staggered among the openings and the suction grip is continuously applied to the foremost sheet.

9. The machine of claim 7 wherein the transfer means includes riffle feed belts positioned to capture the extracted signatures, the riffle feed belts being supported and guided to form at least one bend around which the signatures are carried.

10. The machine of claim 1 wherein the transfer means includes riffle feed belts positioned to capture the extracted signatures, the riffle feed belts being supported and guided to form at least one bend around which the signatures are carried.

11. The machine of claim 10 wherein the riffle feed belts carry the signatures in a substantially flat condition.

12. The machine of claim 1 wherein the supply station includes means for supporting the signatures intermediate their edges.

13. In a machine for feeding signatures, having a first lap and a second lap joined at a backbone, from a supply station to a delivery station, a method of eliminating rolling of the signatures as they depart the supply station comprising the steps of:

stacking the signatures in the supply station with the backbones perpendicular to the direction the signatures will be withdrawn;

engaging the central portion such that the edges of the signatures in the supply station hang downwardly, thereby imparting a curvature to the stacked signatures, the curvature being perpendicular to the direction the signatures will be withdrawn;

extracting signatures successively from the stack in the supply station; and advancing signatures extracted from the stack to the delivery station.

14. A machine for feeding signatures, having a first lap and a second lap joined at a backbone, to a delivery station, comprising:

a supply station in which the signatures are to be first loaded with the backbones perpendicular to the direction the signatures will be withdrawn, the supply station including support means, engageable with the central portion of the signatures such that the edges hang downwardly from the central portion, said support means eliminating rolling of the signatures as they depart the supply station by imparting a curvature to the stacked signatures, the curvature being perpendicular to the direction the signatures will be withdrawn;

a signatures stripper means engageable with the foremost signature of the stack for extracting signatures successively from the stack in the supply station; and transfer means for receiving signatures from the stripper means and advancing them in a stream to the delivery station.

15. A machine for feeding sheets to a delivery station, comprising:

a supply station in which the sheets are to be first loaded in a stack;

a sheet stripper means engageable with the foremost sheet of the stack for extracting sheets successively from the stack in the supply station; and transfer means for receiving sheets from the stripper means and advancing them in a stream to the delivery station;

the sheet stripper means including a vacuum source, traveling suction means for carrying sheets from the stack to the transfer means, the suction means having at least two discrete locations at which the vacuum can be applied for gripping the foremost sheet, and cycling means for supplying the vacuum to the discrete locations of the suction means such that the vacuum is constantly present at at least one location but at each specific location the vacuum is applied during at least two time intervals to a particular sheet being carried, with an intervening period between said two time intervals wherein the vacuum is removed from said specific location.

16. The machine of claim 15 wherein the cycling means includes a riser block having a plurality of passages therethrough which communicate with the vacuum source to convey it to the top surface of the riser block.

17. The machine of claim 10 wherein the traveling suction means comprises an endless belt positioned to traverse the top surface of the riser block while engaging the foremost sheet of the stack, the belt having a plurality of openings therein which, by the motion of the belt, are successively connected and disconnected to the source of vacuum as they traverse the passages of the riser block, whereby the sheet stripper means is effective to extract the foremost sheets of the stack successively by a suction grip and advance them one by one into the transfer means.

18. The machine of claim 17 wherein the openings are arranged in two laterally spaced rows, with adjacent openings in the two row defining longitudinally overlapping pairs.

19. The machine of claim 18 wherein the pairs are longitudinally spaced apart.

20. The machine of claim 16 wherein the riser block passages include a plurality of spaced grooves in the top surface in communication with the vacuum source.

21. The machine of claim 20 wherein the openings are arranged in a plurality of laterally spaced and longitudinally overlapping pairs, with the pairs being longitudinally spaced, and the grooves are spaced apart by a distance at least as great as the longitudinal dimension of the openings.

22. In a machine for feeding sheets from a supply station to a delivery station, a method of extracting sheets from the supply station comprising the steps of:

stacking the sheets in the supply station;

extracting sheets successively from the stack in the supply station by applying traveling suction means to the foremost sheets of the stack at at least two discrete locations and supplying a vacuum to the discrete locations such that the vacuum is constantly present at at least one of said locations but at each particular location the vacuum is applied during at least two time intervals to a particular sheet being carried, with an intervening period between said two time intervals wherein the vacuum is removed from said particular location; and advancing sheets extracted from the stack to the delivery station.

* * * * *